US006491097B1

(12) United States Patent
Oneal et al.

(10) Patent No.: US 6,491,097 B1
(45) Date of Patent: Dec. 10, 2002

(54) ABRASIVE SLURRY DELIVERY APPARATUS AND METHODS OF USING SAME

(75) Inventors: Dean S. Oneal, Lafayette, LA (US); Mark E. P. Dawson, New Orleans, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 4 days.

(21) Appl. No.: 09/738,214

(22) Filed: Dec. 14, 2000

(51) Int. Cl.[7] ..... E21B 43/04

(52) U.S. Cl. ..... 166/278; 166/51; 166/382; 166/386; 166/91.1; 166/222; 166/169

(58) Field of Search ..... 166/278, 51, 381, 166/382, 386, 91.1, 222, 169

(56) References Cited

U.S. PATENT DOCUMENTS

| | | | | |
|---|---|---|---|---|
| 4,644,974 | A | * | 2/1987 | Zingg |
| 5,069,280 | A | | 12/1991 | McKee et al. |
| 5,597,040 | A | | 1/1997 | Stout |
| 5,636,691 | A | | 6/1997 | Hendrickson et al. |
| 5,765,756 | A | * | 6/1998 | Jordan et al. |
| 5,787,985 | A | * | 8/1998 | Oneal et al. |
| 5,829,525 | A | | 11/1998 | Dobson et al. |
| 5,931,229 | A | | 8/1999 | Lehr et al. |

FOREIGN PATENT DOCUMENTS

| | | |
|---|---|---|
| EP | 0935050 A1 | 8/1999 |
| GB | 2275707 A | 9/1994 |
| GB | 2322887 A | 9/1998 |

* cited by examiner

*Primary Examiner*—Roger Schoeppel
(74) *Attorney, Agent, or Firm*—Paul I. Herman; Peter V. Schroeder

(57) ABSTRACT

An improved abrasive slurry delivery apparatus and associated method of using same that permits repeated and/or extended use of the apparatus in a subterranean wellbore, and reduces abrasive wear during fracturing operations while increasing pump rate and proppant mass delivery capabilities. In a preferred embodiment, an abrasive slurry delivery apparatus has a tubular crossover member with an internal flow passage and sidewall outlet openings formed with or without removable inserts formed from abrasive resistant materials. The internal flow passage is eccentrically offset to enlarge the effective flow cross-section, provide for tool passage clearance and to increase wall thickness for protection of a return flow passageway. The sidewall opening is positioned such that the opening is isolated from the secondary flow passageway.

26 Claims, 5 Drawing Sheets

ABRASIVE SLURRY DELIVERY APPARATUS AND METHODS OF USING SAME

BACKGROUND OF THE INVENTION

The present inventions relate generally to tools used in subterranean wells and, in a preferred embodiment thereof, more particularly provide a slurry delivery apparatus for use in formation fracturing operations.

Further, the present inventions relate to improvements in prior art slurry delivery tools and methods of the type shown and described in U.S. Pat. No. 5,636,691, entitled Abrasive Slurry Delivery Apparatus and Methods Of Using Same, which is incorporated by reference herein for all purposes.

As is explained in the above referenced patent, oftentimes, a potentially productive geological formation beneath the earth's surface contains a sufficient volume of valuable fluids, such as hydrocarbons, but also has a very low permeability. "Permeability" is a term used to describe that quality of a geological formation that enables fluids to move about in the formation. All potentially productive formations have pores, a quality described using the term "porosity," within which the valuable fluids are contained. If the pores are not interconnected, the fluids cannot move about and, thus, cannot be brought to the earth's surface.

When such a formation having very low permeability, but a sufficient quantity of valuable fluids in its pores, is desired to be produced, it becomes necessary to artificially increase the formation's permeability. This is typically accomplished by "fracturing" the formation, a practice which is well known in the art, and for which purpose many methods have been conceived. Fracturing is achieved by applying sufficient pressure to the formation to cause the formation to crack or fracture, hence the name. The desired result being that the cracks interconnect the formation's pores and allow the valuable fluids to be brought out of the formation and to the surface.

A conventional method of fracturing a formation begins with drilling a subterranean well into the formation and cementing a protective tubular casing within the well. The casing is then perforated to provide fluid communication between the formation and the interior of the casing. A packer is set in the casing above the well treating equipment to isolate the formation from the rest of the wellbore. In some environments, it is preferable to use a packer of the type that is set using a ball-seat configuration. Dropping a ball through the well tubing to a seat in the tubing string located at the packer sets these packers. The ball acts as a temporary check valve-closing seat, permitting pressure within the tubing string to be increased at the packer to hydraulically set (install) the packer. After the packer is set, tubing pressure is increased further to a point where the ball seat fails and allows the ball to fall down the tubing string to reopen the tubing at the packer. Some fracturing equipment contains internal components made from corrosion resistant material such as carbide or ceramic which cannot tolerate impact with a ball being projected downhole when the seat fails. Some have no space for receiving and storing the ball. In those situations, the ball must be removed by reversing the flow in the well, to flow the ball from the well, rather than by failure of the seat. The process of reverse flow to remove the packer set ball is a time consuming and expensive process, which should be avoided.

In some applications, the tubing string installed with the packer includes perforating equipment located below the fracturing equipment. One type of perforating equipment uses explosive charges that are conventionally actuated by dropping a weighted bar through the tubing string. If the fracturing equipment contains fragile internal components, the weighted bar actuating system cannot be used.

After the packer is set, hydraulic pressure is applied to the formation via tubing extending from the packer to pumps on the surface. The pumps apply the hydraulic pressure by pumping fracturing fluid down the tubing, through the packer, into the wellbore below the packer, through the perforations, and finally, into the formation. The pressure is increased until the desired quality and quantity of cracks is achieved and maintained. Much research has gone into discerning the precise volume and rate of fracturing fluid and hydraulic pressure to apply to the formation to achieve the desired quality and quantity of cracks.

The fracturing fluid's composition is far from a simple matter itself. Modem fracturing fluids may include sophisticated manmade proppants suspended in gels. "Proppant" is the term used to describe material in the fracturing fluid which enters the formation cracks once formed and while the hydraulic pressure is still being applied (that is, while the cracks are still being held open by the hydraulic pressure), and acts to prop the cracks open. When the hydraulic pressure is removed, the proppant keeps the cracks from closing completely. Thus, the proppant helps to maintain the artificial permeability of the formation after the fracturing job is over. Fracturing fluid containing suspended proppant is also called "slurry."

A proppant may be nothing more than very fine sand, or it may be a material specifically engineered for the job of holding formation cracks open. Whatever its composition, the proppant must be very hard and strong to withstand the forces trying to close the formation cracks. These qualities also make the proppant a very good abrasive. It is common for proppant to form holes in the protective casing, tubing, pumps, and any other equipment through which slurry is pumped.

Particularly susceptible to abrasion wear from pumped slurry is any piece of equipment in which the slurry must make a sudden or significant change in direction. The slurry, being governed by the laws of physics and fluid dynamics including the principles of inertia, tends to maintain its velocity and direction of flow, and resists any change thereof. An object in the flow path of the slurry, which tends to change the velocity or direction of the slurry's flow will soon be worn away as the proppant in the slurry incessantly impinges upon the object.

Of particular concern in this regard is the piece of equipment attached to the tubing extending below the packer, which takes the slurry as it is pumped down the tubing and redirects it radially outward so that it exits the tubing and enters the formation through the perforations. That piece of equipment is called a crossover. Assuming, for purposes of convenience, that the tubing extends vertically through the wellbore, and that the formation is generally horizontal, the crossover must change the direction of the slurry by ninety degrees. Because of this significant change of direction, few pieces of equipment (with the notable exception of the pumps) must withstand as much abrasive wear as the crossover.

In addition, the crossover is frequently called upon to do several other tasks while the slurry is being pumped through it. For example, the crossover typically contains longitudinal circulation ports through which fracturing fluids, that are not received into the formation after exiting the crossover, are transmitted back to the surface. Space limitations in the wellbore dictate that the circulation ports are not far removed from the flow path of the slurry through the crossover. If the crossover is worn away such that the slurry flow path achieves fluid communication with the circulation ports in the crossover, the fracturing job must cease. Once stopped, the fracturing job cannot be recommended or completed. Hence, it is very important that the crossover does not fail while the job is in process. If the fracturing job is not halted after the crossover fails, the slurry will enter the circulation ports in the crossover and travel back to the surface without delivering the proppant to the formation.

For the above reasons and others, the crossover has commonly been considered a disposable piece of equipment, usable for only one fracturing job, or worse, less than one fracturing job. Even when it survives a fracturing job, it is usually sufficiently worn that no further use may be made of it. This is unfortunate because the crossover is also typically one of the most expensive pieces of equipment used in a fracturing job due to its high machining and material costs. Further, customers are now demanding fracturing jobs with high flow rates, high pressures, higher volumes, and higher density proppant. All of this increase wear on the crossover increases the likelihood of crossover failure during the fracturing job.

Attempts have been made to provide a solution for these problems. One involves making the crossover out of extremely hard and abrasion wear-resistant materials. This has proven to reduce the rate of abrasion wear of the crossover.

It is, however, enormously expensive to make an entire crossover out of a sufficiently wear-resistant material. No economic advantage is actually achieved by this solution over the disposable crossover made of less wear-resistant, but much less expensive, materials.

Another proposed solution is to utilize surface treatment of less expensive alloy steels to achieve a wear-resistant crossover surface. Methods such as carburizing, nitriding, etc., which produce a high surface hardness, do indeed slow the abrasion wear rate of the crossover at less expense than using exotic materials. However, as soon as the hardened surface layer has been breached, the crossover begins to wear away rapidly. For this reason, surfacehardened crossovers are also not sufficiently durable for the newer high flow, high pressure fracturing jobs. The extra expense of surface-hardening a disposable crossover makes this solution uneconomical as well.

Other proposals involve placing replaceable protective sleeves or liners of wear or corrosive resistant materials in the crossover. These sleeves are placed in the areas subjected to abrasion such as the central tubing passageway. However, as previously pointed out, the better corrosive resistant materials are brittle and subject to impact damages from contact with packer setting balls and perforator activator bars. This potential for damage limits the use of these crossovers. Further protective sleeves take up space in the internal flow path, reducing the flow capacity and tool passage ability of the crossover.

Another area of concern concerning abrasion wear during fracturing jobs is the protective casing lining the wellbore. Since the crossover typically directs the slurry flow radially outward, the casing is directly in the altered slurry flow path. Unintended, misplaced holes in the casing are to be avoided, since it is the casing which provides the only conduit extending to the surface through which all other conduits and equipment must pass.

From the foregoing, it can be seen that it would be quite desirable to provide an improved slurry delivery apparatus, which does not have the economic disadvantages of the solutions, enumerated above, but which allows repeated use thereof. It would also be desirable to provide a slurry delivery apparatus that has a full bore internal passage to increase flow capacity and tool clearance. In addition, it would be desirable to locate replaceable wear resistant components out of the main passageway and out of potential tool damaging areas. Accordingly, it is an object of the present invention to provide such a slurry delivery apparatus and associated methods of using same.

SUMMARY OF THE INVENTION

In carrying out the principles of the present invention, in accordance with an embodiment thereof, an abrasive slurry delivery apparatus and method of using same are provided, which apparatus and method are specially adapted for utilization in formation fracturing operations in subterranean wellbores.

In broad terms, an abrasive slurry delivery apparatus and method is provided which includes a first tubular structure having a flow inlet communicating with an internal flow passage through which a pressurized, abrasive slurry material may be axially flowed in a downstream direction. The internal flow passage is positioned eccentrically within the tubular structure, to form a thickened axially extending wall section. An axially extending bypass flow passage formed in the thickened wall section, and an axial portion of the tubular structure having a side wall section, with an outlet opening therein through which an abrasive slurry material may be outwardly discharged from the internal flow passage. The outlet opening being circumscribed by a peripheral edge portion of the side wall section, and protective means for shielding the peripheral edge portion of the side wall section from abrasive slurry material being discharged outwardly through the outlet opening, with or without the protective means of abrasive resistant ported inserts removably or permanently mounted in the side wall flush with or recessed from the internal flow passage. It is preferable but not required that these outlet openings will be aligned such to promote maximum volume with equal distribution of flow throughout the length of the crossover with specific spacing, number and size of the ports. These outlet holes shall encompass the entire surface area (radially) with the possible exception of that area left for the bypass return ports.

BRIEF DESCRIPTION OF THE DRAWINGS

The accompanying drawings are incorporated into and form a part of the specification to illustrate several examples of the present inventions. These drawings, together with the description, serve to explain the principals of the inventions. The drawings are only for the purpose of illustrating preferred and alternative examples of how the inventions can be made and used, and are not to be construed as limiting the inventions to only the illustrated and described examples. The various advantages and features of the present inventions will be apparent from a consideration of the drawings in which.

DETAILED DESCRIPTION

Figure 1:
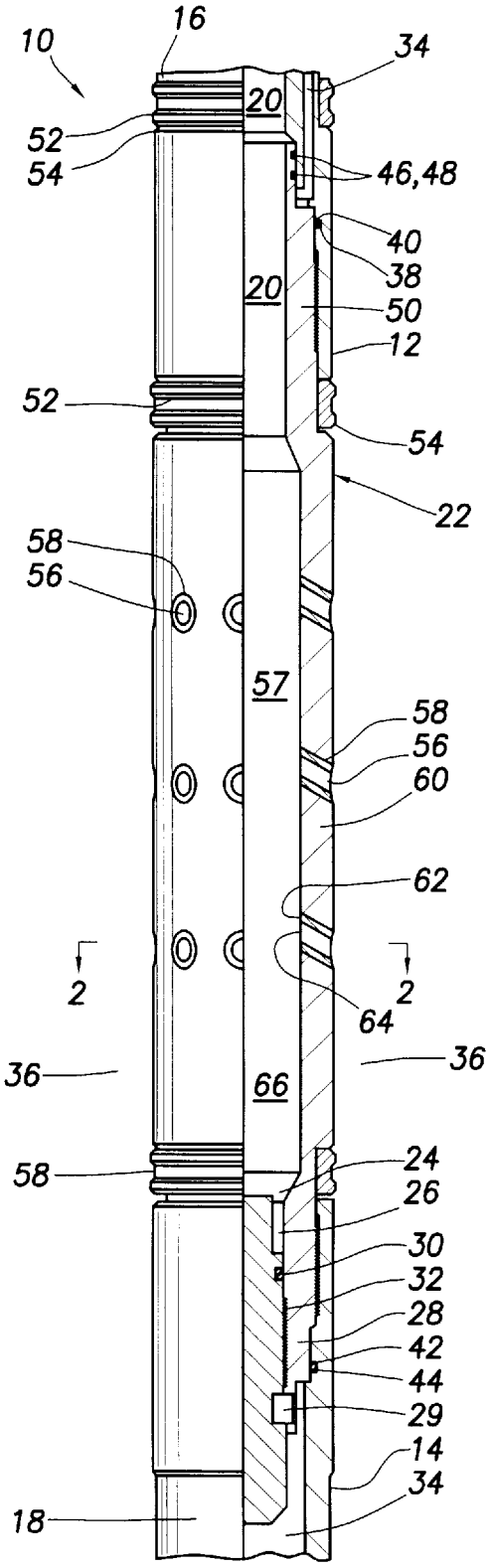
FIG. 1 is a partially cross-sectional view of a portion of a tubing string containing a slurry delivery apparatus with a crossover tool embodying principles of the present invention.

The present inventions will be described by referring to drawings of apparatus and methods showing various examples of how the inventions can be made and used. In these drawings, reference characters are used throughout the several views to indicate like or corresponding parts. In FIG. 1, there is an abrasive slurry delivery apparatus 10 which embodies principles of the present invention as illustrated. The top of the drawing is intended to be toward the surface and the bottom of the drawing page toward the well bottom. While wells commonly are laid out in a vertical direction, it is understood that inclined and horizontal configurations exist. When the descriptive terms "up and down" are used in reference to a drawing, they are intended to indicate location on the drawing page, and not necessarily orientation in the ground, as the present inventions have utility no matter how the well bore is orientated.

Apparatus 10, as representatively illustrated in FIG. 1, is specially adapted for use within a tool string known to those skilled in the art as a service tool string (not shown), which is suspended from tubing extending to the earth's surface, the tubing being longitudinally disposed within protective casing in a subterranean wellbore. The service tool string is typically inserted through a packer (not shown) during a fracturing job. A pressurized, abrasive slurry is then pumped through the tubing and into the service tool string. Tubular upper connector 12 and lower connector 14 permit interconnection of the apparatus 10 into the service tool string. Accordingly, upper portion 16 of upper connector 12 is connected to the service tool string above the apparatus 10, and lower portion 18 of lower connector 14 is connected to the remainder of the service tool string extending below the apparatus. Axial flow passage 20 extends longitudinally (i.e., axially) downward from the upper portion 16 of upper connector 12, axially through the upper connector, and into a generally tubular crossover 22. The axial flow passage 20 terminates at upper radially reduced portion 24 of tapered seat with ports and ball 26. Seat 26 is either installed or is an integral part of lower portion 28 of crossover 22 . Sealing engagement between the seat 26 and the lower portion 28 of crossover 22 is provided by seal 30 disposed in circumferential groove 32 externally formed on the plug.

Radially displaced, longitudinally extending, circulation flow passage 34 extends downwardly from upper portion 16, through the upper connector 12, longitudinally through the crossover 22 in a manner that will be described more fully hereinbelow, through the lower connector 14, and to lower portion 18. When operatively installed in a wellbore 36, the circulation flow passage 34 in the apparatus 10 is sealingly isolated from the wellbore external to the apparatus by seal 38 disposed in circumferential groove 40 internally formed on the upper connector 12, and by seal 42 disposed in circumferential groove 44 internally formed on the lower connector 14. The circulation flow passage 34 is sealingly isolated from coaxial flow passage 20 in the apparatus 10 by seal 30, and by a pair of seals 46, each disposed in one of a pair of circumferential grooves 48 externally formed on an upper portion 50 of the crossover 22 which extends coaxially into the upper connector 12.

Annular antifriction seal rings 52 are disposed in longitudinally spaced apart external annular recesses 54 formed on upper portion 16 of upper connector 12, between upper connector 12 and crossover 22, and between crossover 22 and lower connector 14. The antifriction seal rings 52 ease insertion and movement of the apparatus 10 within the packer and other equipment into which the apparatus 10 may be longitudinally disposed, as well as providing an effective seal there between.

Upper portion 50 of crossover 22 is threadedly attached to upper connector 12, and lower portion 28 of the crossover is threadedly attached to lower connector 14.

A plurality of cylindrical outlet openings or exit ports 56 provide fluid communication between the interior chamber 57 of crossover 22 which communicates with the axial flow passage 20 and the wellbore 36. It is through these exit ports 56 that a slurry must pass in its transition from longitudinal flow in the axial flow passage 20 to radial flow into the wellbore 36. Because of the substantial change of direction from longitudinal flow to radial flow of the slurry through the exit ports 56, the exit ports are particularly susceptible to abrasion wear from proppant contained in the slurry.

In order to protect the exit ports 56 against abrasion wear, the ports 56 are preferably formed in inserts 58 or are hardened without inserts. These inserts are removably mounted in wall 60 of the crossover 22. The inserts 58 are made of a suitably hard and tough abrasion resistant material, such as tungsten carbide, or are made of a material, such as alloy material, which has been hardened. If made of an alloy material, the inserts 58 are preferably through-hardened by a process such as case carburizing or nitriding. Other materials and hardening methods may be employed for the inserts 58 without deviating from the principles of the present invention. The inserts 58 are preferably made of tungsten carbide, ceramic or other abrasive resistant material.

The inserts 58 are secured into the wall 60 by press fit, threads, pins, snap rings or the like or a combination of fasteners. As will be described in detail herein, the interior ends 62 are contoured to conform to the interior surface of the chamber 57. In other words, the interior facing surfaces on ends 62 form extensions of the interior surface chamber to form a smooth flow surface. The upper portion 64 of insert 58 extends axially upward past the exit ports 56 in the crossover 22, thereby completely internally overlapping that portion of the crossover 22 in which the exit ports 56 are located. Transition surface 64 formed in crossover 22 provides a smooth transition between the passage 20 and chamber 57 maintaining a flush inside surface.

Figure 4A:
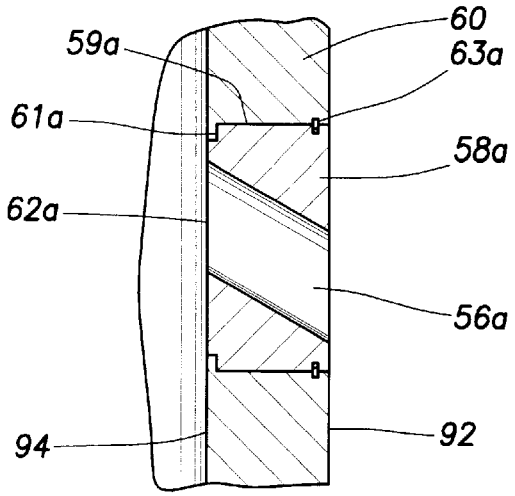
FIG. 4A is an enlarged scale cross-sectional view of one embodiment of the insert mounted in the wall of the crossover of the slurry delivery apparatus.
Figure 4B:
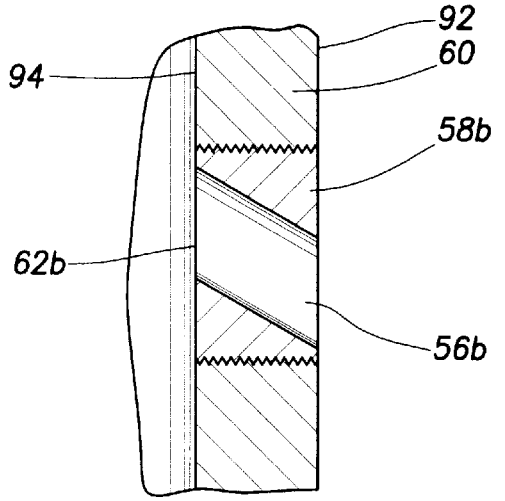
FIG. 4B is an enlarged scale cross-sectional view similar to FIG. 4A of another embodiment of the insert mounted in the wall of the crossover of the slurry delivery apparatus.

An upwardly opening interior hollow cylindrical volume within the crossover 22 above the upper portion 24 of the seat 26 forms sump area 66. As the slurry flows longitudinally downward through the coaxial flow passage 20 into the crossover 22, the slurry will enter the well 66 and quickly fill the sump area. Thereafter, the downwardly flowing slurry will directly impinge on the portion of the slurry, which has filled the sump 66, effectively preventing the slurry from abrading any portion of the crossover 22 or seat with ball 26, due to direct longitudinal impingement by the slurry. Alternatively, the crossover 22 could have a substantially solid and generally cylindrical sacrificial insert in place of the well 66, as shown in FIGS. 4A and 4B of U.S. Pat. No. 5,636,691.

This has been described as a unique configuration of slurry delivery apparatus 10, wherein the crossover 22 is protected from abrasion wear due to slurry flow by an abrasion resistant inserts 58, the inserts acting to prolong the useful life. Sump area 66 effectively minimizes abrasion wear due to longitudinally directed flow of the slurry.

Figure 2:
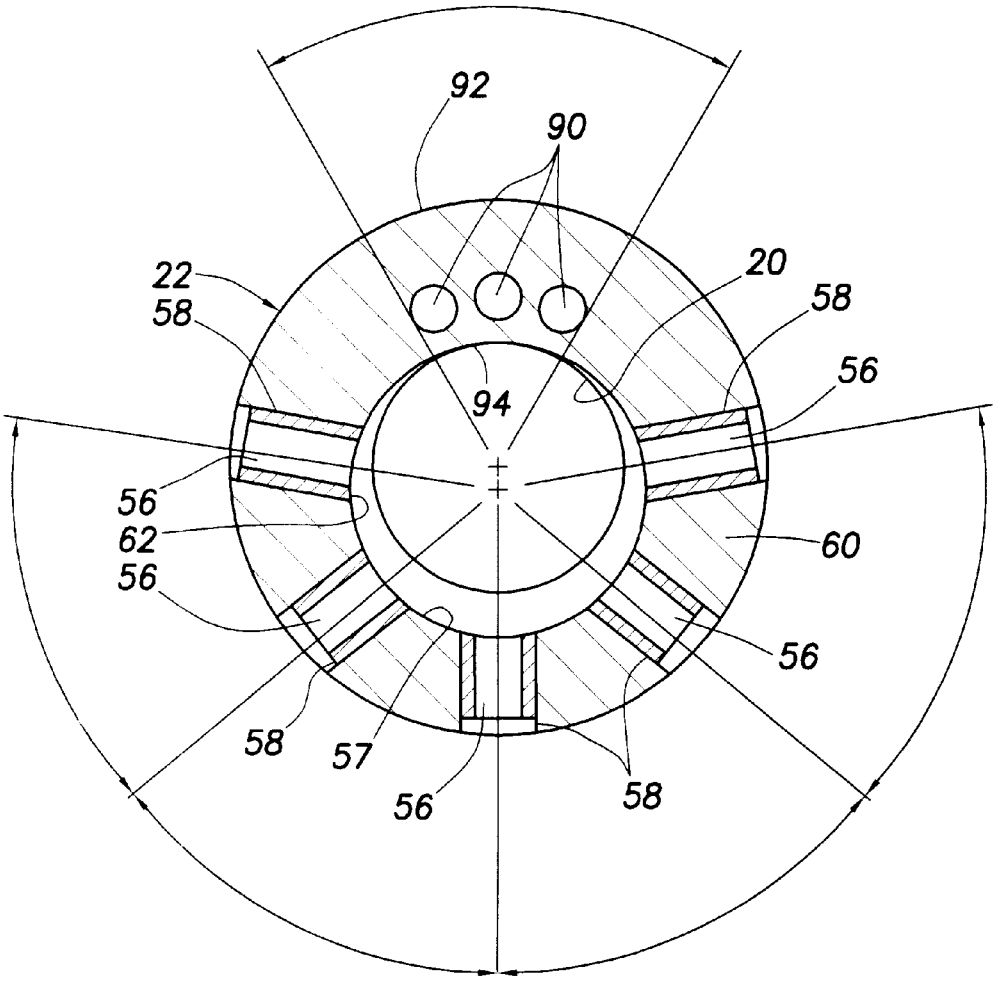
FIG. 2 is an enlarged cross-sectional view of the crossover of the slurry delivery apparatus, taken along line 2—2 of FIG. 1 looking in the direction of the arrows.

Turning now to FIG. 2, a cross-sectional view may be seen of the apparatus 10 representatively illustrated in FIG. 1. The cross-section is taken through line 2—2 of FIG. 1 which extends laterally through the crossover 22. In this view, the manner in which circulation flow passage 34 extends longitudinally through the crossover 22 may be seen.

In FIG. 2, three longitudinally extending and circumferentially spaced bypass circulation ports 90 are disposed in the wall 60 of the crossover 22. In this embodiment bypass, ports 90 are positioned intermediate outer surface 92 of the crossover 22 and the interior surface 94 of interior chamber 57. In the disclosed embodiment, three ports are shown, for example, only in that more or less could be utilized. The ports are illustrated as having equal cross sections, but it is possible that the ports may different diameters which would not sacrifice structural integrity. Ports 90 (secondary flow) are utilized in some processes, and it is essential the flow in ports 90 remain isolated from interior chamber 57 (primary flow).

It is to be noted that the wall 60 adjacent to the interior chamber 57 has a non-uniform thickness. As seen in FIG. 2, in the twelve o'clock location, the wall has its maximum thickness, and at the six o'clock location, the wall has its minimum thickness. This change in thickness is created by the fact that the interior chamber 57 is eccentrically offset from, and is larger, than the flow passage 20 in the upper portion 22. The offset creates a thicker wall portion around the ports 90 adding to the structural integrity and resistance to erosion failure by connecting the bypass port 90 to the chamber 57. Offsetting the chamber 57 achieves an additional advantage in that it increases the cross sectional area in comparison to U.S. Pat. No. 5,636,691, which in turn lowers flow velocities in the crossover to reduce flow erosion.

FIG. 2 illustrates another advantage in preventing abrasion wear of the crossover 22. It can be clearly seen that if exit ports 56 are allowed to wear appreciably circumferentially outward, the exit ports 56 are axially spaced from the circulation ports 90. Any abrasive wear occurring around ports 56 would not engage ports 90 because of their radial spacing there from.

Figure 3:
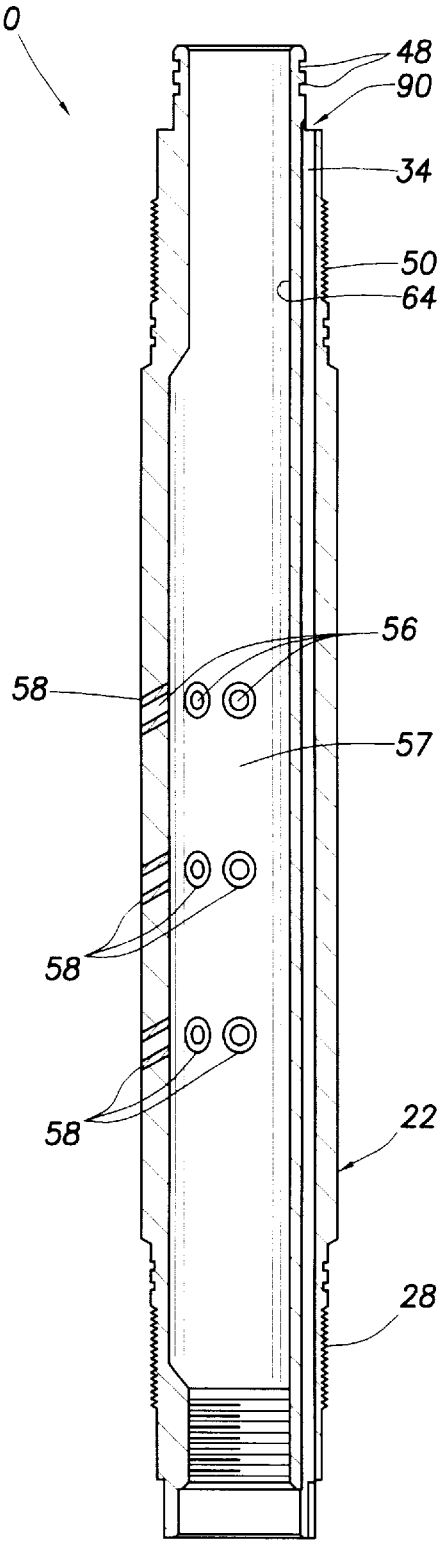
FIG. 3 is an enlarged scale cross-sectional view of the crossover of the slurry delivery apparatus, taken along line 3—3 of FIG. 2 looking in the direction of the arrows.

Turning now to FIG. 3, a cross-sectional view of the crossover 22, taken laterally along line 3—3 of FIG. 2 may be seen. For illustrative clarity, only the crossover 22 is shown in FIG. 3, and details of the offset between chamber 57 and flow passage 20 is shown. Note that the offset is eccentric to the flow chamber but not larger in inside diameter. FIG. 3 further illustrates the manner in which the circulation ports 90 are formed in the crossover 22.

Figure 4C:
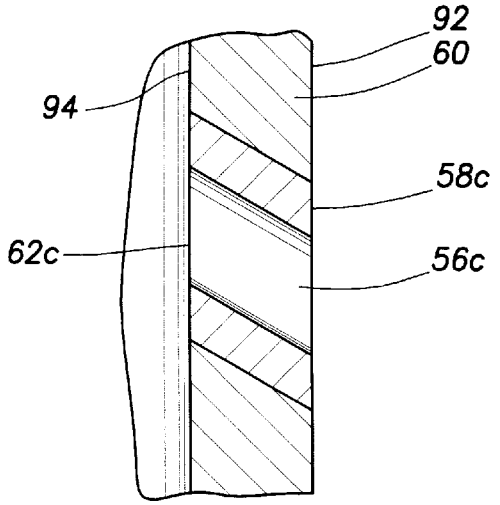
FIG. 4C is an enlarged scale cross-sectional view similar to FIG. 4A of another embodiment of the insert mounted in the wall of the crossover of the slurry delivery apparatus.

FIGS. 4A–4C illustrate various embodiments of the insert 58. In FIG. 4A, the insert is identified as 58*a*. Insert 58*a* (and the other inserts illustrated and described herein) is constructed from hard abrasive material such as carbide, ceramic or the like. Insert 58*a* has a cylindrical exterior surface 59*a*, which mates with a cylindrical bore in wall 60. Radial shoulders 61*a* are formed in the wall of bore and on the exterior surface 59*a* adjacent the inner end 62*a* to locate the insert 58*a* in the bore. A snap or other type of retaining ring 63*a* can be mounted in wall 60 to removably retain insert 58*a* in the bore. It should be noted that the port 56*a* formed in insert 58*a* is inclined with respect to the surface 58 and bore. The interior and exterior ends of insert 58*a* are concentric with the interior surface 94 and exterior surface 92 of wall 60.

In FIG. 4B, insert 58*b* is removably mounted in the bore in wall 60 by threaded engagement between interior threads in the bore and exterior threads on the insert 58*b*. As in the FIG. 4A embodiment, the port 56*b* is inclined in the insert 58*b*. The ends of this insert 58*b* are likewise concave and convex shaped to be concentric with the respective surfaces of wall 60. The interior end 62*b* of the insert is formed concentric with the interior surface 94 of wall 60.

In FIG. 4C, insert 58*c* has a cylindrical exterior surface, but is mounted in an inclined bore in wall 60. Port 56*c* in insert 58*c* is coaxial with the center of the exterior surface. The interior end 62*c* is formed concentric with the interior surface 94 of wall 60. The exterior end of insert 58*c* is likewise concentric with the exterior surface 92 of wall 60. Insert 58*c* is illustrated as being mounted in the bore in wall 60 by press fit, but it is to be understood that any of the illustrated inserts could be mounted by any of the means illustrated herein, or by other mechanical means.

Figure 4D:
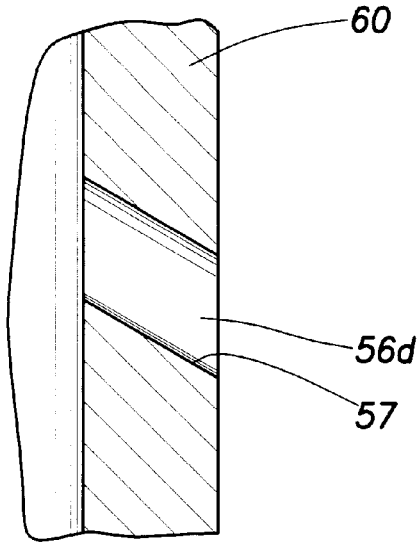
FIG. 4D is an enlarged scale cross-sectional view similar to FIG. 4A of an embodiment of the port with no insert in the wall of the crossover of the slurry delivery apparatus.

In FIG. 4D the bore in the wall 60 is shown as in FIGS. 4A–4C to form the port 56*d* the surface 57 of the bore is hardened in a manner known in the arts.

Figure 4E:
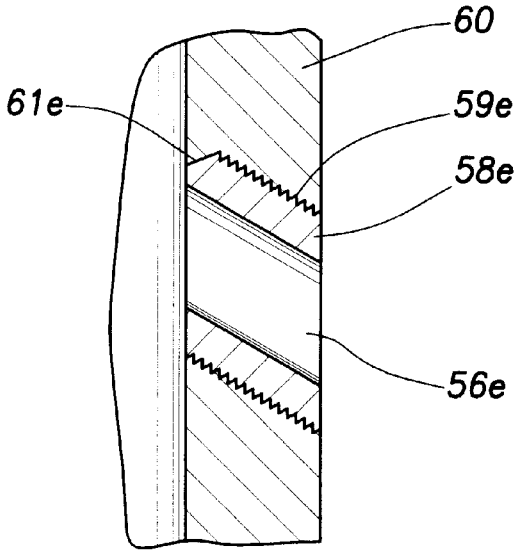
FIG. 4E is an enlarged scale cross-sectional view similar to FIG.4A of another embodiment of the insert mounted in the wall of the crossover of the slurry device.

In FIG. 4E, insert 58*a* is disposed in the wall 60 in the manner of the embodiment shown and described in FIG. 4C. In this embodiment, however, the insert 58*e* is mounted in the bore 60 with a retention bushing 61 threaded on its inner 63 and outer 65 surfaces. Corresponding threads are provided on the inner surface of the bore and the outer surface of the insert.

Figure 5:
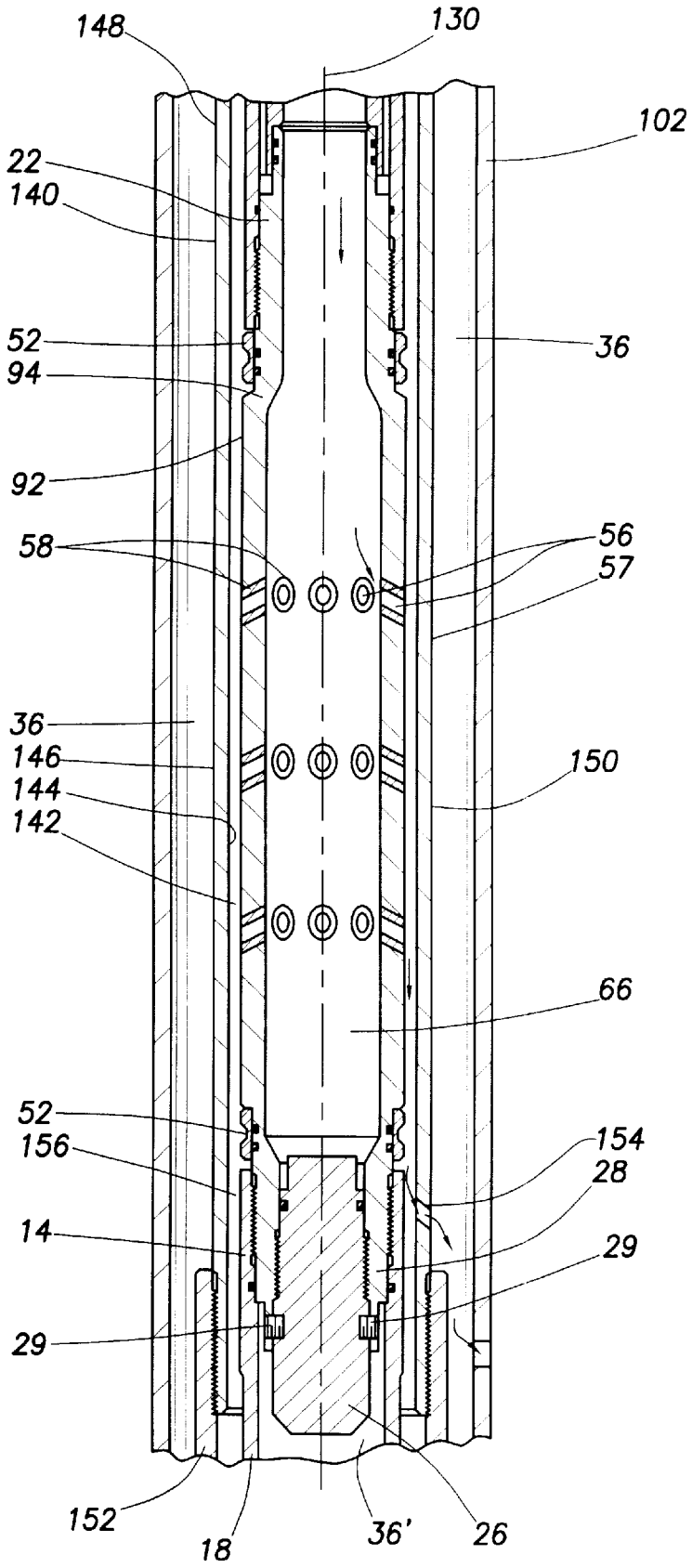
FIG. 5 is a cross-sectional view of the slurry delivery apparatus of FIG. 1, further having a casing protective flow sub.

FIG. 5 is a sectional view of a crossover tool 22 of the present invention similar to FIG. 1 positioned in and outer flow sub 140 in a subterranean well casing 102. FIG. 5 shows the apparatus 10 having a coaxially disposed outer tubular flow sub 140 completely exteriorly overlapping the crossover 22. An annular flow area 142 is thereby formed radially between the outer surface 92 of the crossover 22 and inner diameter 144 of the flow sub 140. Outer surface 146 of the flow sub 140 is exposed to the wellbore 36 contained in casing 102. An upper portion 148 of the flow sub 140 extends longitudinally upward, and is suspended from the packer (not shown). A lower portion 150 of the flow sub 140 is threadedly secured to a lower connector 152 from which further equipment may be attached and suspended.

Extending radially through the flow sub 140 and providing fluid communication from the annular flow area 142 to the wellbore 36 are circumferentially spaced slurry ports 154 (only two of which are visible in FIG. 5). Slurry ports 154 are inclined with respect to the centerline 130 in order to induce a longitudinally downward component to the radially directed slurry flow as it exits the slurry ports 154.

The inclination of the slurry ports 154 acts to reduce direct impingement of the radially directed slurry flow on any equipment external to the flow sub 140. In particular, the inclination of the slurry ports 154 reduces abrasion wear of the casing 102. It is to be understood that a range of inclination angles and number of slurry ports 154 may be utilized without departing from the principles of the present invention. It is also understood that the slurry ports may be used in conjunction with a closing sleeve assembly instead of a flow sub. Slurry ports 154 are longitudinally downwardly displaced relative to the exit ports 56 in the crossover 22 such that the slurry cannot flow directly radially outward from the exit ports 56 and through the slurry ports 154. The slurry must flow, after exiting exit ports 56, at least partially longitudinally downward through annular flow area 142 before it may flow radially outward through slurry ports 154. Thus, the slurry is made to impinge upon the inner wall 144 of the flow sub 140 after the slurry exits the exit ports 56.

An annular sump area 156 is longitudinally downwardly disposed relative to the slurry ports 154. Annular sump area 156 performs a function similar to that performed by sump area 66 within crossover 22. Soon after the slurry flow commences, annular sump area 156 will fill with the slurry material and provide a fluid "cushion" for the longitudinally downward flow of the slurry in the annular flow area 142. Flow sub 140 is preferably made of an abrasion resistant material. Since the slurry flow impinges upon the inner diameter 144 of the flow sub 140 before exiting the slurry ports 154, the inner diameter 144 is particularly susceptible to abrasion wear therefrom. For this reason, the flow sub 140 is preferably made of an alloy material and surfaced hardened at least on the inner diameter 144 by a nitriding or carburizing treatment. It is to be understood that other materials and surface treatments may be utilized without departing from the principles of the present invention.

The embodiments shown and described above are only exemplary. Many details are often found in the art such as: packer assemblies, packer seals, packer actuators, explosives, charges and carriers therefore. Therefore, many such details are neither shown nor described. It is not claimed that all of the detail parts, elements, or steps described and shown, were invented herein. Even though numerous characteristics and advantages of the present inventions have been set forth in the foregoing description, together with details of the structure and function of the inventions, the disclosure is illustrative only, and changes may be made in the detail, especially in matters of shape, size, and arrangement of the parts within the principles of the inventions to the full extent indicated by the broad general meaning of the terms used the attached claims.

The restrictive description and drawings of the specific examples above do not point out what an infringement of this patent would be, but are to provide at least one explanation of how to make and use the inventions. The limits of the inventions and the bounds of the patent protection are measured by, and defined in the following claims:

What is claimed is:

1. Abrasive slurry delivery apparatus operative for placement in a subterranean wellbore, comprising:

a tubular structure having an internal flow passage through which a pressurized, abrasive slurry material may be axially flowed in a downstream direction;

an axial portion of the tubular structure having a circumferentially extending side wall section with one or more outlet openings therein through which an abrasive slurry material may be outwardly discharged from the internal flow passage, the outlet openings being circumscribed by a peripheral edge; and shielding for protecting the peripheral edge portion of the side wall section from abrasive slurry material being discharged outwardly through the outlet openings, the shielding comprising inserts mounted in the side wall and formed from abrasive resistant material and wherein the inserts each contain passageways communicating with the outlet openings through which an abrasive slurry material may be discharged where by the peripheral edge portion of the outlets resist abrasion from flow of the abrasive slurry.

2. The abrasive slurry delivery apparatus of claim 1 wherein the axial portion of the first tubular structure is a tubular crossover member.

3. The abrasive slurry delivery apparatus of claim 1 wherein the insert is removably mounted in the wall section.

4. The abrasive slurry delivery apparatus of claim 1 wherein the passageway in the inserts is inclined axially downward.

5. The abrasive slurry delivery apparatus of claim 1 wherein the insert is cylindrical and is mounted in an inclined passageway in the side wall.

6. The abrasive slurry delivery apparatus of claim 1 wherein the side wall section has axially and circumferentially spaced outlet openings formed therein.

7. The abrasive slurry delivery apparatus of claim 1 wherein the side wall section extends through less than the entire periphery.

8. The abrasive slurry delivery apparatus of claim 1 wherein the side wall section is circumferentially discontinuous.

9. The abrasive slurry delivery apparatus of claim 1 wherein the side wall section extends through the circumference of the axial portion minus the allotted area for flow.

10. The abrasive slurry delivery apparatus of claim 1 wherein the insert has threads mating with threads on the side wall section.

11. The abrasive slurry delivery apparatus of claim 1 wherein the insert is mounted in an opening in the side wall section and is retained therein by a retaining ring.

12. The abrasive slurry delivery apparatus of claim 1 additionally comprising:

a second tubular structure coaxially and outwardly circumscribing the axial portion of the first tubular member and forming therewith an annular flow passage that circumscribes the axial portion, the second tubular structure having a side wall section spaced apart from the side wall section in the tubular member; and a port formed in the second tubular structure side wall section, the annular flow passage and the second port cooperating to cause abrasive slurry being outwardly discharged from the outlet openings in the side wall section to flow in a downstream direction through the annular flow passage before being discharged outwardly through the port, the outlet openings being operative to discharge abrasive slurry material therefrom along a path sloped radially outwardly in a downstream direction, and the port being operative to discharge abrasive slurry material therefrom along a path sloped radially outwardly in a downstream direction.

13. The abrasive slurry delivery apparatus of claim 1 further comprising:

a second side wall section of the tubular member having a second flow passage extending axially through the second side wall section and the second flow passage is isolated from the internal flow passage.

14. The abrasive slurry delivery apparatus of claim 13 wherein the second tubular structure has a downstream end portion disposed downstream from the port, and the abrasive slurry delivery apparatus further comprises wall means for closing off the annular flow passage at the downstream end portion to form from an axial portion of the annular flow passage downstream from the port a sump area for receiving abrasive slurry material discharged from the port.

15. The abrasive slurry delivery apparatus of claim 1 further comprising:

axially spaced inlet and outlet ports in the tubular structure open for fluid and tool passage through the internal flow passage.

16. The abrasive slurry delivery apparatus of claim 15 wherein the internal flow passage has a flow cross-section area at least as large as the inlet port.

17. The abrasive slurry delivery apparatus of claim 15 wherein the internal flow passage and the inlet port have circular cross sections and have axes that are radially separated.

18. The abrasive slurry delivery apparatus of claim 1 additionally possibly comprising:

a cylindrical sacrificial insert member coaxially received in the tubular member.

19. The abrasive slurry delivery apparatus of claim 18 wherein the sacrificial insert member is of a solid cylindrical configuration.

20. The abrasive slurry delivery apparatus of claim 18 wherein the sacrificial insert member is of a hollow tubular configuration with the upstream and downstream end thereof initially being open and the downstream end thereof later being closed, whereby the interior of the sacrificial insert member forms a sump for receiving and containing a quantity of abrasive slurry material.

21. The abrasive slurry delivery apparatus of claim 1 wherein the outlet opening in the side wall section is sloped radially outwardly in either a downstream or upstream direction.

22. The abrasive slurry delivery apparatus of claim 21 wherein the outlet opening is further sloped tangentially in a radially outward direction.

23. The abrasive slurry delivery apparatus of claim 21 wherein the axial portion is a tubular crossover member, and further comprising a tubular flow sub member.

24. The abrasive slurry delivery apparatus of claim 23 further comprising:

a wear resistant structure interiorly carried on the tubular flow sub member and positioned to be impinged upon by abrasive slurry material being discharged from the outlet opening.

25. A method of inhibiting slurry erosion of an abrasive slurry delivery apparatus having an outer wall with outlet ports extending there through the method comprising the steps of:

providing replaceable inserts of abrasive resistant material having a peripheral edge portion;

removably mounting the inserts in the outlet ports of the outer wall of the abrasive slurry delivery apparatus in a manner such that the peripheral edge portions of the inserts protects the outlet ports from erosion due to slurry material being forced outwardly there through;

positioning the abrasive slurry delivery apparatus in a subterranean well and flowing abrasive slurry material through the outlet ports; thereafter removing the delivery apparatus from the well; and removing and replacing the inserts in the outer wall of the delivery apparatus.

26. A method of inhibiting slurry erosion of the peripheral edge in a subterranean tool, the tool having a tubular structure with a side wall section, at least one outlet opening defined by a peripheral edge in the side wall section, the method comprising the steps of:

providing at least one replaceable insert of abrasive resistant material for protecting the peripheral edges;

removably mounting the insert in the side wall of the tubular structure such that the at least one insert protects the at least one peripheral edge from abrasive slurry material being forced outwardly therethrough;

positioning the tubular structure in a subterranean well;

flowing abrasive slurry material through an internal passage of the tubular structure and through the at least one outlet opening;

thereafter removing the tubular structure from the well; and removing and replacing the inserts in the side wall of the tubular structure.

* * * * *